United States Patent [19]

Thomas et al.

[11] Patent Number: 4,764,853

[45] Date of Patent: Aug. 16, 1988

[54] RECHARGEABLE BATTERY CAFE TABLE LAMP

[76] Inventors: Stephen E. Thomas, 38840 Godfrey Pl., Fremont, Calif. 94536; Mark S. Thomas, 1235 Wildwood Ave., Sunnyvale, Calif. 94089

[21] Appl. No.: 60,028

[22] Filed: Jun. 9, 1987

[51] Int. Cl.[4] ..... F21L 7/00

[52] U.S. Cl. ..... 362/183; 362/20; 362/392

[58] Field of Search ..... 362/183, 392, 810, 20

[56] References Cited

U.S. PATENT DOCUMENTS 3,373,274 3/1968 Kott ..... 362/183

4,029,954 6/1977 Moyer ..... 320/2

4,535,391 8/1981 Hsiao ..... 362/183

*Primary Examiner*—E. Rollins Cross

*Attorney, Agent, or Firm*—Linval B. Castle

[57] ABSTRACT

An imitation candle type of table lighting fixture contains one or more rechargeable batteries. While the lamp is in its holder, the battery is continously coupled to the small light bulb. The battery is recharged by removing the candle from the holder and plugging it into a recharging unit having a phone plug extending into a jack centered in the bottom of the candle. The insertion of the plug into the jack opens the light bulb circuit and forms a charging circuit through the rechargeable battery.

9 Claims, 1 Drawing Sheet

RECHARGEABLE BATTERY CAFE TABLE LAMP

BACKGROUND OF THE INVENTION

This invention relates generally to table lamps and particularly to a novel rechargeable battery operated table lamp specifically for use in the food and beverage industry and which has the appearance of a candle lamp.

The lamp to be described will serve to increase the acceptance of rechargeable battery table lamps, and thus increase the favorable impact of such lamps in the following specified areas:

Safety: In many areas of the country fire marshalls are banning "open flame" light fixtures at tables to protect customers, employees and buildings from fire hazard. By utilizing battery powered table lights this hazard is removed. The rechargeable battery lamps also provide safety and usable emergency lighting in the event of power blackout, thus complying with many existing statutes requiring standby emergency lighting in public facilities.

Ecology: Air pollution from the burning of a multiplicity of "open flame" candle fixtures is eliminated by the use of rechargeable battery lighting. There is no longer any wax laden candle smoke for patrons to breathe and the stench of snuffed out candles is eliminated.

Energy Conservation: In warmer climates, open flame candles burning in a closed area generate significant heat that air conditioners must overcome. For example, the estimated increase in electrical costs per month for air conditioning equipment to overcome the heat output from forty open flame light fixtures in a resturant is over fifty dollars per month. This represents a considerable waste of energy when one totals the thousands of food and beverage establishments using open flame light fixtures.

Another energy saving is realized at the end of each work shift when a clean-up crew requires adequate flood lighting for proper cleaning of an establishment. When flame light candle lamps are used, extra time is required to change candles and clean the soot and wax from the lighting fixtures and table areas. By use of battery table lamps, the work time is materially reduced with a corresponding reduction in the flood lighting requirements and power usage. When such battery powered lamps are used, the intimate lighting with ability to read menus is maintained with a great reduction in main overhead room ambient light levels and a meaningful saving in energy.

Rechargeable battery powered table lamps are often considered objectionable because of the continual need to change batteries. A fully charged battery should power a small flicker-type lamp with illumination equal to that of a normal table lamp candle for about eight to ten hours, a period quite adequate for most applications. But then the spent battery in each lamp at each table must be replaced with a fully charged battery for the next day use. This involves a costly expenditure for labor to remove the spent battery from the lamp, insert a new fully charged battery, place the spent battery in a recharger, and later to gather the now recharged batteries from the charger.

The battery lamp to be described and claimed employs rechargeable batteries but avoids the above discussed problems. There is no removal and replacing of reachargeable batteries from the lamp, and no handling of batteries in a recharger. When a battery becomes spent, the entire lamp is replaced in less time than that required to relight a candle in a candle lamp. Further, there is no lost labor expended in removing lamp bulbs from the fixture to facilitate battery charging. By allowing the bulbs to remain mounted in the lamp unit, no loss of misplaced and/or broken bulbs occurs.

BRIEF DESCRIPTION OF THE INVENTION

Briefly described our table lamp is candle-shaped to fit within a stand. The lamp contains a rechargeable battery and has a small light bulb centered at the top representing the flame and a normally closed 3-contact phone jack centered in the bottom surface. There is no switch. When the "candle" is placed in its table stand there is a closed circuit through the battery, the closed circuit jack, and and lamp, and the lamp remains on. When the battery requires recharging, the entire candle shaped lamp is lifted from its stand and inserted into a charger having a phone plug which opens the lamp circuit and closes a second circuit through the charger, the jack, and the battery to thereby recharge the battery.

BRIEF DESCRIPTION OF THE DRAWINGS

In the drawing which illustrate the preferred embodiment of the invention.

DETAILED DESCRIPTION OF THE PREFERRED EMBODIMENT

Figure 1:
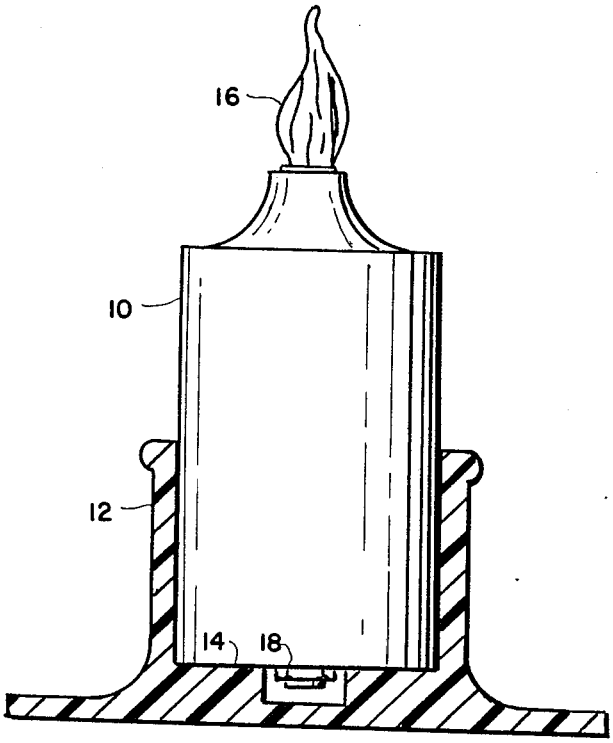
FIG. 1 is an elevational view of the table lamp in a sectionally illustrated table stand.

FIG. 1 illustrates a cylindrical candle shaped lamp 10 inserted in a bse or table stand 12 which, when on a horizontal table, supports the lamp in a vertical position. The stand may be an ornamental plastic with a cylindrical central opening to receive the lamp which rests on a horizontal floor 14 in the bottom of the opening.

The candle shaped lamp 10 has a small low voltage light bulb 16 centered in the top surface and a miniature phone jack 18 is centered in the lower surface. To provide suitable clearance for the jack, the floor 14 in the stand is counterbored as shown.

Figure 2:
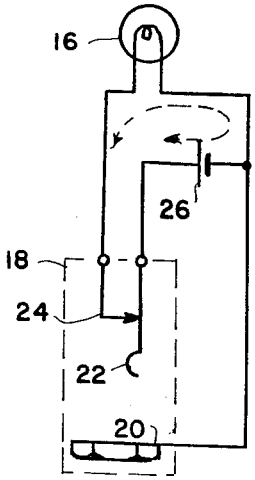
FIG. 2 is an electrical schematic of the circuitry of the table lamp while in its table stand.

As shown in FIG. 2, the phone jack 18 is a 3-element, normally closed type having a body element 20, a plug tip element 22, and a third element 24 which contacts the element 22 only if a phone plug has not been inserted into the jack. The third element 24 is coupled through the light bulb 16 to the negative terminal of a rechargeable battery 26, the positive terminal of which is coupled directly to the plug tip element 22. Thus, when the lamp 10 is inserted in its table stand 12 and when there is no phone plug in the jack 18, there is electrical continuity from the battery 26, through plug tip element 22, third element 24, the bulb 16, and to the negative terminal of the battery 26. The light bulb is therefore continuously on.

Figure 3:
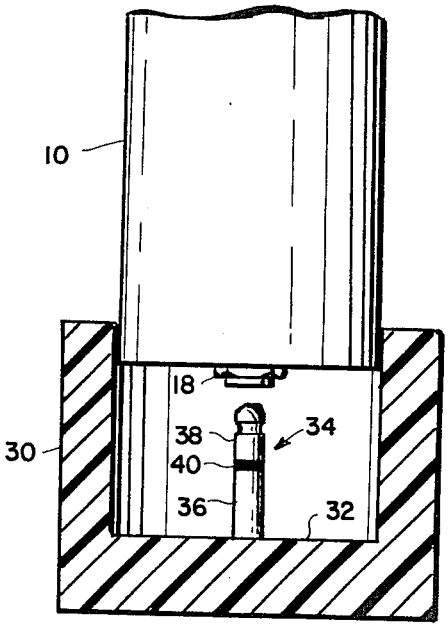
FIG. 3 is an elevational view of the table lamp partially inserted in a sectionally illustrated battery charger stand.

At the end of a working day, or whenever a battery becomes discharged, the entire lamp 10 is withdrawn from its stand 12 and plugged into a battery charger 30 such as shown in FIG. 3. The charger body may have a flat floor surface or may be formed with a plurality of cylindrical or self-centering frustrum openings, each for receiving one lamp 10, and centered in the floor 32 of each opening is a vertically positioned miniature phone plug 34. Each phone plug typically is formed with a body contact 36 at a negative or system ground potential and a tip contact 38 electrically separated from the body contact by an insulator 40. As illustrated in the schematic drawings of FIG. 4, the body 36 is coupled to a negative bus 42 and the tip 38 is coupled to the positive bus 44 of a battery recharger having a plurality of phone plugs for accomodating a corresponding plurality of rechargeable battery lamps.

Figure 4:
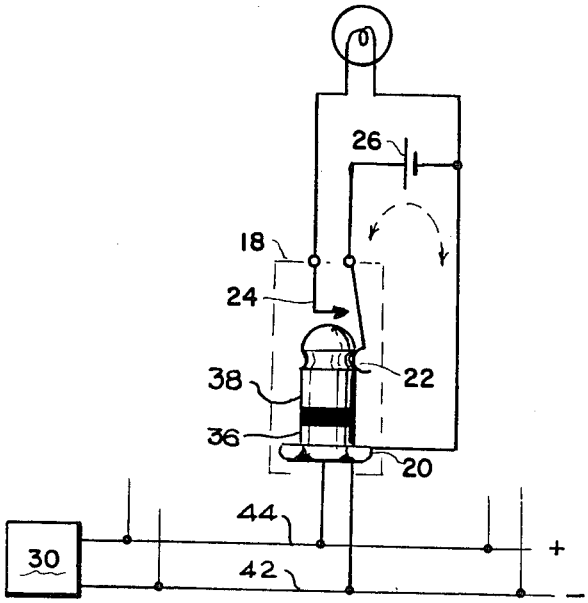
FIG. 4 is an electrical schematic of the circuitry of the table lamp in the battery charger.

As shown in FIG. 4, the insertion of the phone plug 34 into the jack 18 in the base of the lamp 10 forces out the resilient arm of the tip element 22 so that the third element 24 no longer can contact the tip element. With the third element 24 now out of circuit, no current can flow through the light bulb 16, and the electrical circuit now includes the body element 20 of the jack 18, the tip element 22, and the battery 26. The spent battery is thus recharged whenever the lamp 10 is plugged into the charger 30. And the light bulb 16 is lighted whenever the lamp 10 is removed from the charger.

What is claimed is:

1. A battery operated table lighting fixture including:

a candle shaped housing having top and bottom end surfaces;

a lamp extending from the top end surface of said housing;

a phone jack positioned in the bottom end surface of said housing, said jack having an electrically conductive body element, a resilient tip element, and third element normally in electrical contact with said tip element, said tip element and said third element being recessed from said bottom end surface;

a battery within said housing;

first series circuitry including said lamp, said battery, and said jack for electrically energizing said lamp from said battery; and second series circuitry including said battery and said jack for opening said first series circuitry to said lamp upon the insertion of a phone plug into said phone jack.

2. The lighting fixture claimed in claim 1 wherein said battery is a rechargeable battery.

3. The lighting fixture claimed in claim 2 wherein said lamp and said phone jack are centered in the top and bottom end surfaces, respectively, of said housing.

4. The lighting fixture claimed in claim 3 further including battery charging means coupled to said phone plug for recharging said rechargeable battery.

5. The lighting fixture claimed in claim 4 wherein said battery charging means is coupled to a plurality of identical phone plugs in parallel for simultaneously recharging a plurality of batteries upon insertion of said phone plugs into the phone jacks in a plurality of lighting fixtures.

6. A rechargeable battery operated lighting fixture comprising:

a candle shaped housing having top and bottom end surfaces;

a table mounting for supporting said housing;

a lamp extending from the center of the top end surface of said housing;

a phone jack centrally positioned in the bottom end surface of said housing, said jack having a first element, a second element, and third element normally in electrical contact with said second element but forced out of electrical contact by the insertion of a phone plug into said jack, said second and said third elements being recessed in said housing and spaced from said bottom end surface; and circuitry including said lamp, said second and third elements and the rechargeable battery for energizing said lamp when said second and third elements are in electrical contact and for forming a battery recharging circuit including said first and second elements and said battery upon insertion of a phone plug into said phone jack.

7. The lighting fixture claimed in claim 6 further including battery recharging means coupled to a phone plug for insertion into said phone jack.

8. The lighting fixture claimed in claim 7 wherein said lamp in said fixture is continuously coupled to the battery while said candle shaped housing is supported in a table mounting.

9. The lighting fixture claimed in claim 8 wherein said lamp is disconnected from said battery when a phone plug is inserted in said phone jack.

* * * * *